US007056221B2

(12) United States Patent
Thirkettle et al.

(10) Patent No.: US 7,056,221 B2
(45) Date of Patent: Jun. 6, 2006

(54) BALL COLLECTION ARRANGEMENT

(75) Inventors: John S. Thirkettle, Long Marston (GB); David V. Jolliffe, Herts (GB)

(73) Assignee: World Golf Systems Limited, Herts (GB)

( * ) Notice: Subject to any disclaimer, the term of this patent is extended or adjusted under 35 U.S.C. 154(b) by 0 days.

(21) Appl. No.: 10/416,989

(22) PCT Filed: Nov. 19, 2001

(86) PCT No.: PCT/GB01/05098

§ 371 (c)(1),
(2), (4) Date: Sep. 16, 2003

(87) PCT Pub. No.: WO02/40111

PCT Pub. Date: May 23, 2002

(65) Prior Publication Data

US 2004/0063510 A1 Apr. 1, 2004

(30) Foreign Application Priority Data

Nov. 17, 2000 (GB) ..... 0028101.4

(51) Int. Cl.
*A63B 69/36* (2006.01)

(52) U.S. Cl. ..... 473/168; 473/192; 473/153

(58) Field of Classification Search ..... 473/168–170, 473/151, 153, 166, 172, 192
See application file for complete search history.

(56) References Cited

U.S. PATENT DOCUMENTS

| | | | | |
|---|---|---|---|---|
| 1,862,093 | A * | 6/1932 | Murray | 473/163 |
| 3,504,912 | A * | 4/1970 | Jenney | 473/168 |
| 3,649,025 | A * | 3/1972 | Garland | 473/157 |
| 3,990,708 | A * | 11/1976 | Ingwersen | 473/153 |
| 4,141,557 | A * | 2/1979 | Ingwersen | 473/192 |
| 4,171,812 | A * | 10/1979 | Marsin | 473/168 |
| 5,108,102 | A * | 4/1992 | Logan | 473/166 |
| 5,265,875 | A * | 11/1993 | Fitzgerald | 473/169 |
| 5,370,389 | A | 12/1994 | Reising | 273/35 |
| 5,439,224 | A * | 8/1995 | Bertoncino | 473/153 |
| 5,445,374 | A * | 8/1995 | Clark, Jr. | 473/191 |
| 5,513,841 | A * | 5/1996 | Takagi | 473/134 |
| 6,325,726 | B1 * | 12/2001 | Helstrom | 473/168 |
| 6,569,028 | B1 * | 5/2003 | Nichols et al. | 473/192 |
| 6,592,464 | B1 * | 7/2003 | Helstrom | 473/168 |

FOREIGN PATENT DOCUMENTS

| | | |
|---|---|---|
| DE | 19726565 | 12/1998 |
| WO | WO 93/25286 | 12/1993 |
| WO | WO 99/48046 | 12/1999 |

OTHER PUBLICATIONS

PCT/GB01/05098 International Search Report.

* cited by examiner

*Primary Examiner*—Mark S. Graham
(74) *Attorney, Agent, or Firm*—Sheridan Ross P.C.

(57) ABSTRACT

A golf driving range target (112) comprises pockets (150, 183) suspended for cables (146, 176), the pockets feeding received golf balls to a common receptacle. Between the exits (166) of the pockets and the common receptacle, the balls, which are coded, pass code-reading devices for identification. The pockets have walls (162, 165) which are shaped to direct received balls quickly to the exit (166) and may have internal ball-directing baffle members (163, 167). The pockets may be arranged concentrically or in an array.

13 Claims, 7 Drawing Sheets

BALL COLLECTION ARRANGEMENT

The present invention relates to a ball collection arrangement and in particular to a target used in an automated golf driving range such as described in WO 99/48046.

WO 99/48046 discloses a range with golf screens and targets; each target area and the hole of each green is provided with a coded ball reader. U.S. Pat. No. 5,370,389 discloses a range with target greens, each of which have a single hole for collecting and reading the ball. WO 93/25286 discloses a golf range with targets provided with optical scanners to pass ball identification information to a programmed computer, the targets comprising a sloping surface divided into concentric circles.

The above-described prior art arrangements suffer from one or more disadvantages. For example, they are made of relatively hard material so that a golf ball can bounce off them to another part of the target or completely off the target. Moreover, only limited information is provided about the particular part of the target where the golf ball landed. In addition the targets can be susceptible to harsh weather conditions.

According to a first aspect of the present invention, there is provided an arrangement for receiving golf balls comprising a plurality of mutually adjacent pockets of flexible material, each pocket having an outlet at the bottom connected to a common receptacle for collecting golf balls.

The pockets are preferably made of fabric or plastics and may be made of sheet material or net material. Net material has the advantage that rain passes straight through. A particularly waterproof arrangement is provided if the pockets are made of plastics or plastics-coated material.

The collection arrangement preferably forms part of a target in an automated golf driving range. The golf balls are preferably coded and pass a reading device which detects the codes and indicates the region where each golf ball landed on a display near the driving tee. Bach pocket may have its own individual reading device. Alternatively, the target area may be divided into one or more zones, each of which has its own ball code reading device, with a plurality of pockets constituting each zone.

The edges of the pocket may be suspended from webs extending across an opening in the ground. The ends of the webs are supported at the edges of the opening; in addition they may be supported at intermediate points by poles. The webs are preferably resilient so that, upon impact by a golf ball, they deflect to absorb the momentum of the ball, which thus drops into an adjacent pocket.

The pockets are readily releasable from the web members for ease of access and maintenance. For example the top edges of the pockets may have lengths of hooked touch-and-close material stitched thereto, which co-operate with corresponding lengths on the web members.

In a preferred arrangement, the attachment of a said pocket to a said web member is by means of a plurality of hook members along an edge of the pocket, the hook members being attached to the web member from the side thereof remote from the pocket. An advantage of this arrangement is that, with two pockets attached to a single web member at opposite sides thereof with the hook members interleaved along the web member, the edges of the pockets are held tight against each other to avoid gaps therebetween.

The material of each pocket is preferably held fairly taut between its edges at the top and its outlet at the bottom. This ensures that a collected ball quickly leaves the pocket via the outlet. The angle of the sides of the pocket relative to the horizontal preferably lies within the range 35° to 80°, more preferably 45° to 70°. The most preferred value is substantially 60°.

The pockets may be arranged in an array or matrix. Alternatively, they are arranged in concentric circles or any other desired configuration.

According to a second aspect of the present invention, there is provided an arrangement for receiving golf balls comprising an array of mutually adjacent compartments, each compartment having an outlet at the bottom connected to a common receptacle for collecting golf balls.

The compartments preferably have the general shape of inverted pyramids.

The array is preferably in the form of compartments defined between radial lines and concentric circles. Alternatively, the array may be a matrix formed of rows and columns, or in the form of a honeycomb or other desired configuration. By assigning each compartment, or a group comprising a relatively small number (e.g. 5 to 20, preferably 10) of compartments, to a respective zone and incorporating a ball code reading device at the outlet of each zone, it is possible to quickly feed back accurate information about where a golf ball lands to a display adjacent to the driving tee.

Preferred embodiments of the present invention will now be described, by way of example only, with reference to the accompanying drawings, of which:

Figure 1:
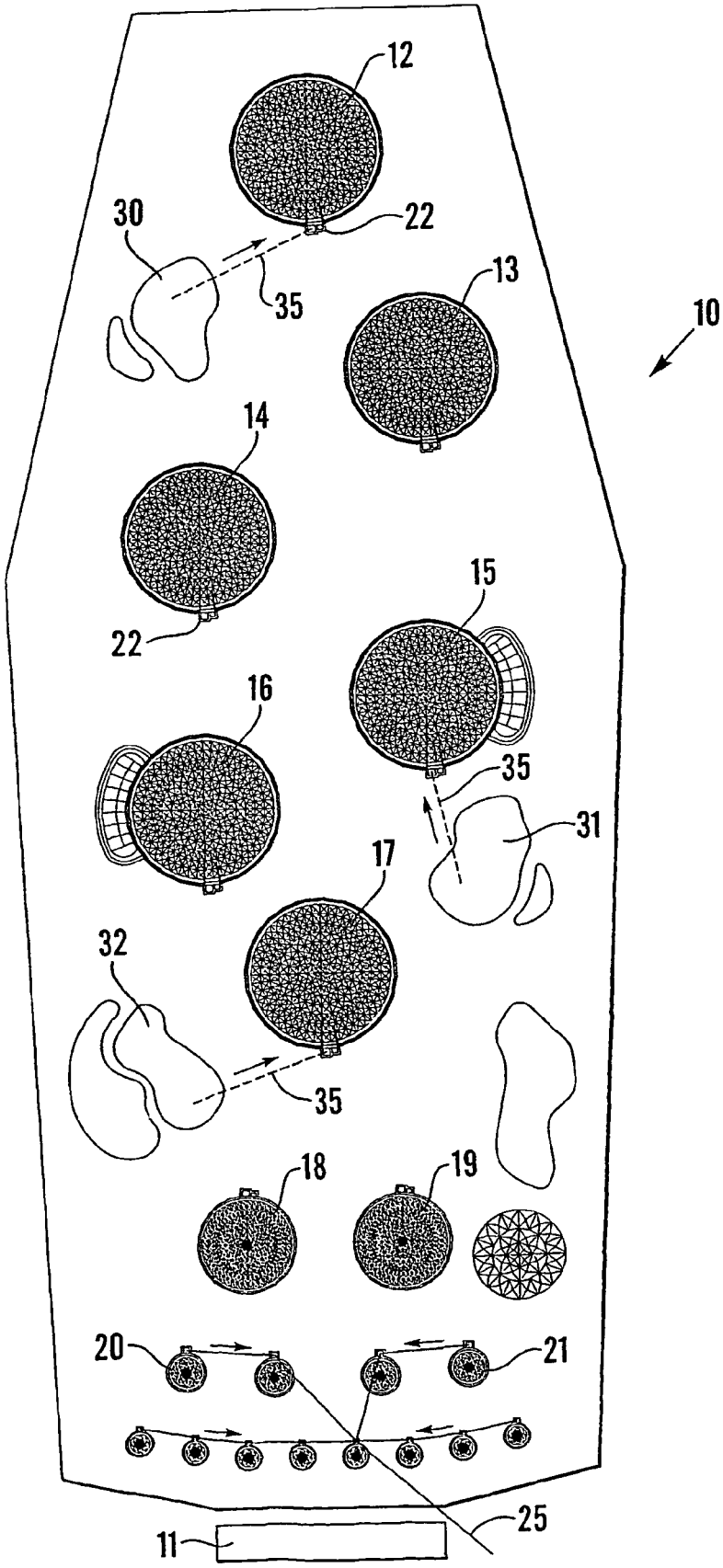
FIG. 1 is a plan of a golf driving range incorporating ball collection arrangements in accordance with a first embodiment of the present invention.

Referring to the drawings, a golf driving range 10, which may be of the type disclosed in WO 99/48046, comprises a range building 11, incorporating a plurality of driving tees arranged in one or more decks, and a plurality of targets 12–21. Targets 12–17 are 25 meters in diameter, 18 and 19 are 15 meters, targets 20 are 5 meters, and targets 21 are 2½ meters in diameter. Coded golf balls landing on one of the targets 12–19 are collected and identified as described below and then passed to a respective hopper or other receptacle 22 in a manhole beneath an accessible cover. Balls are intermittently collected from the receptacles 22 when the driving range is not in use.

For the nearer targets 20, 21 the collected and identified balls are returned immediately via a feed channel 25 to a handling room in or adjacent to the range building 11.

The driving range may also incorporate one or more target greens 30–32. Each green slopes towards its hole which has an outlet feed channel 35 connected to the receptacle 22 for an adjacent target.

Figure 2:
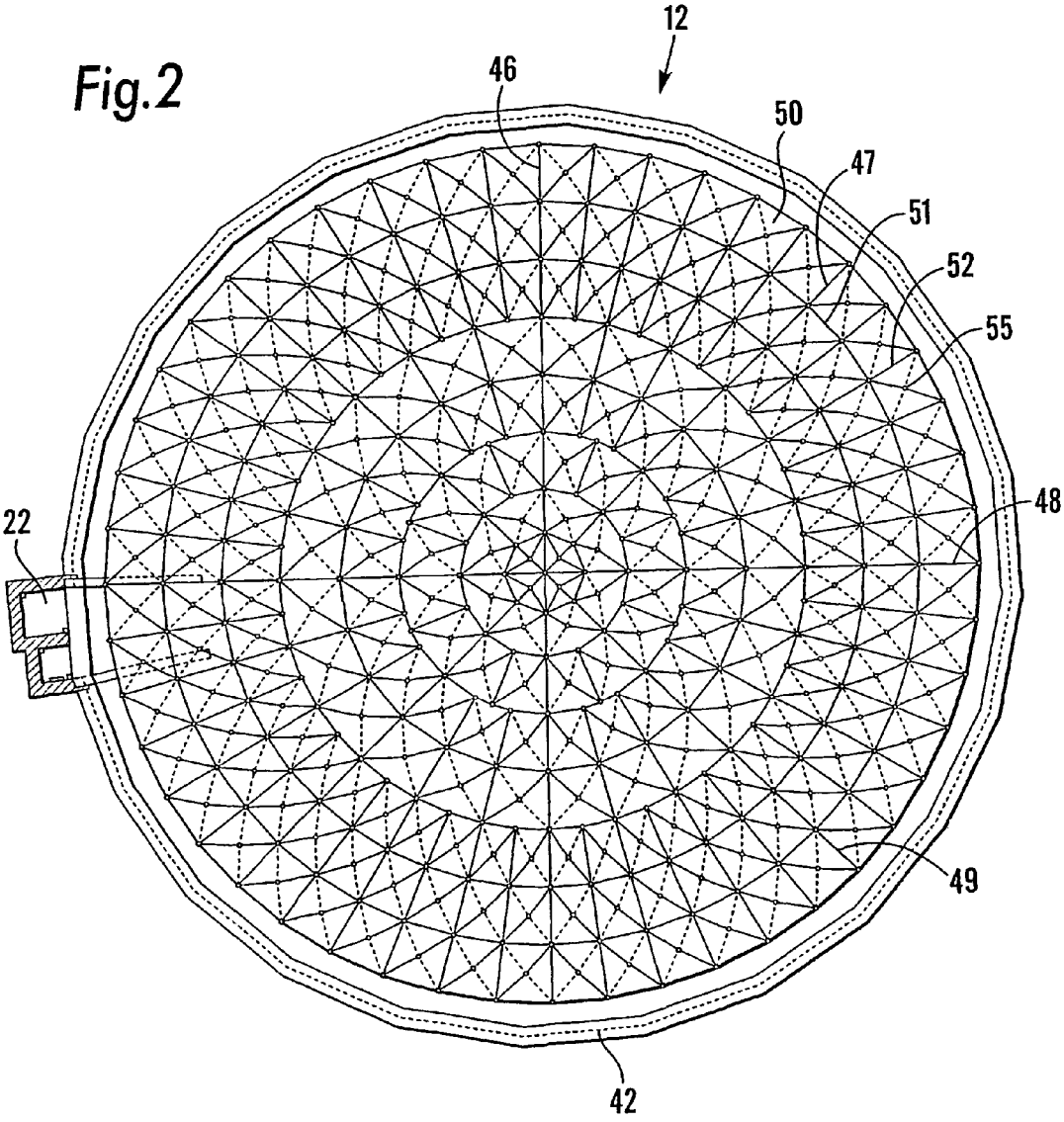
FIG. 2 is a top plan view of a ball collection arrangement as shown in FIG. 1.
Figure 3:
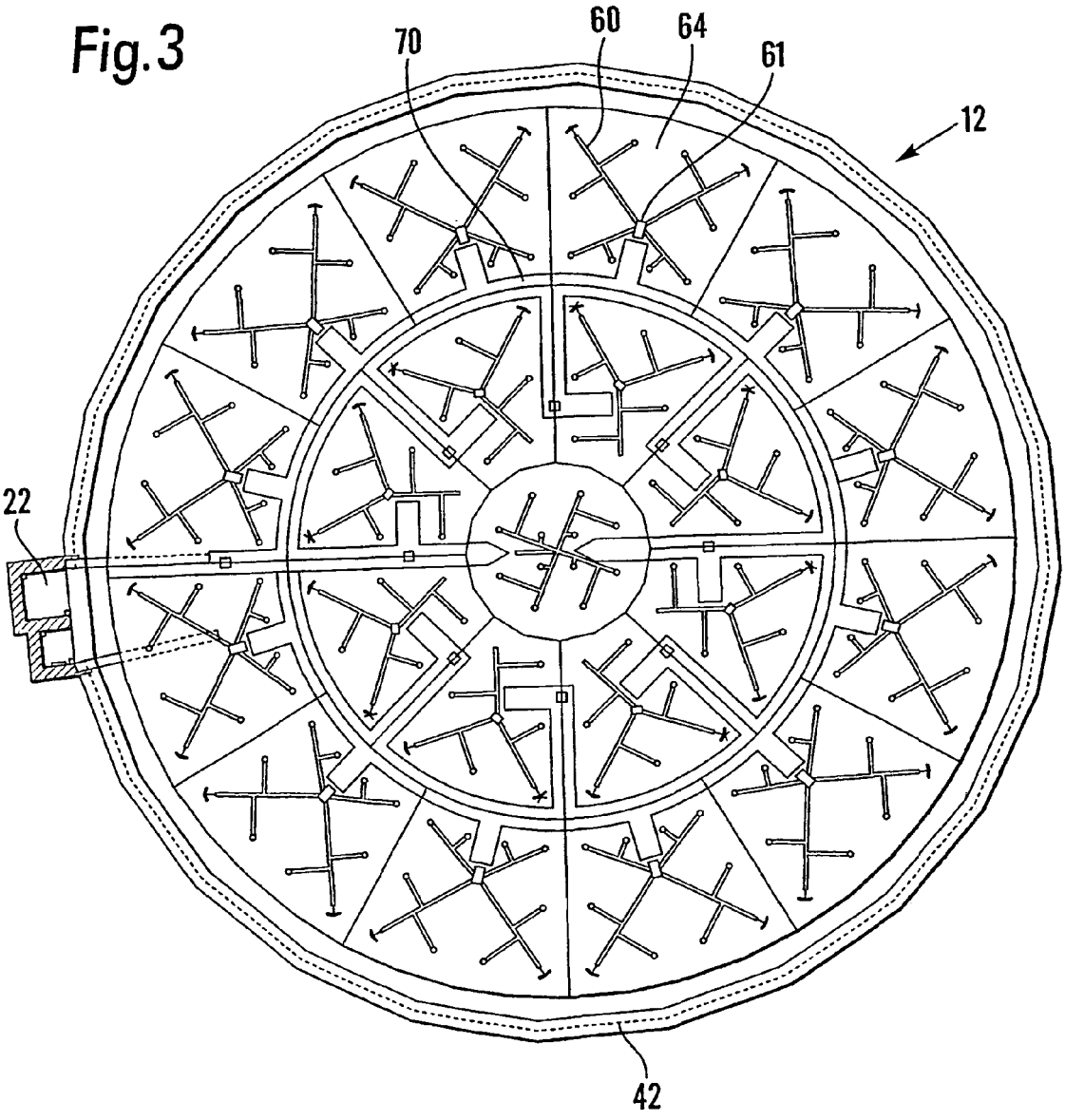
FIG. 3 is a view similar to FIG. 2 but with the collecting pockets or compartments removed.
Figure 4:
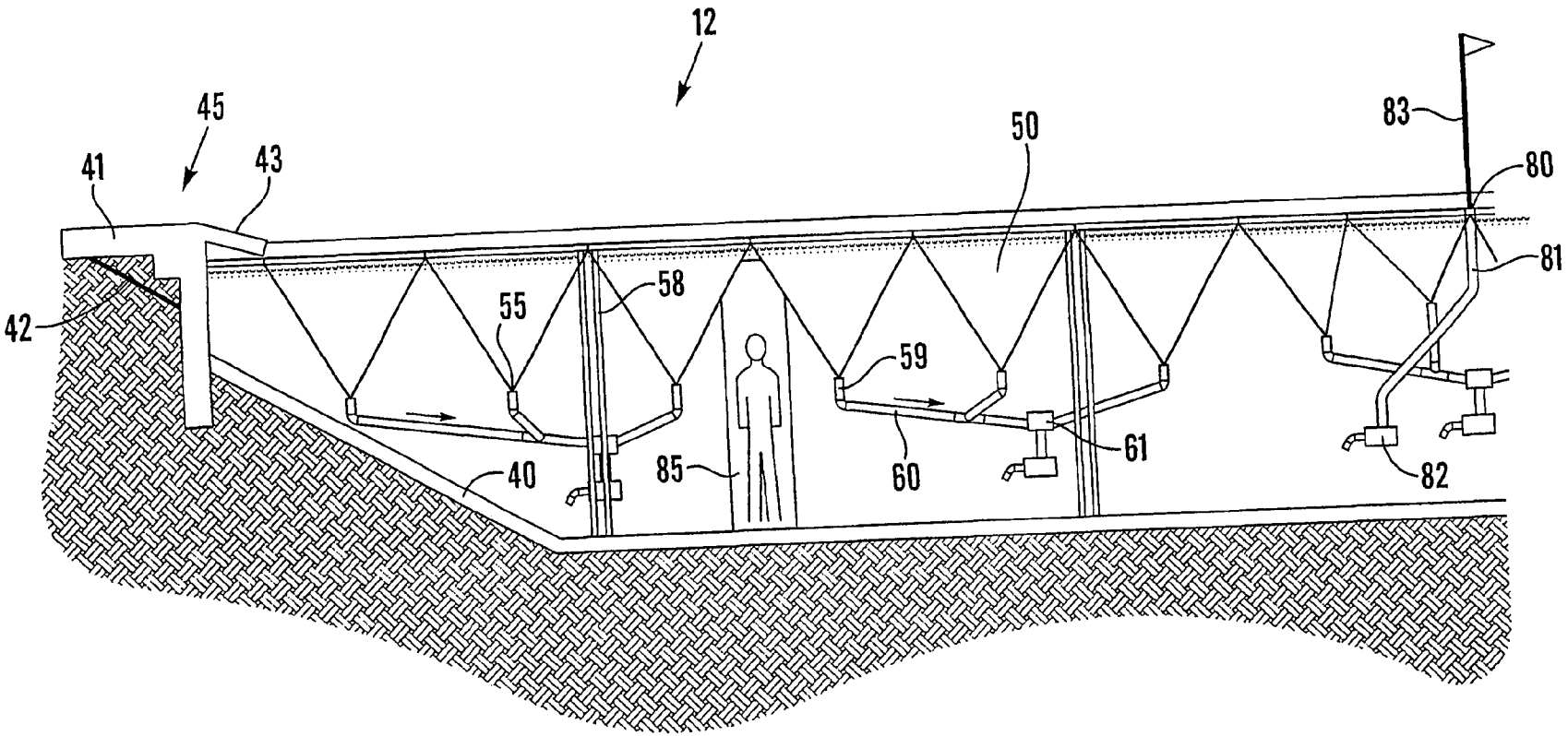
FIG. 4 is a sectional side view of the arrangement of FIGS. 2 and 3.
Figure 5:
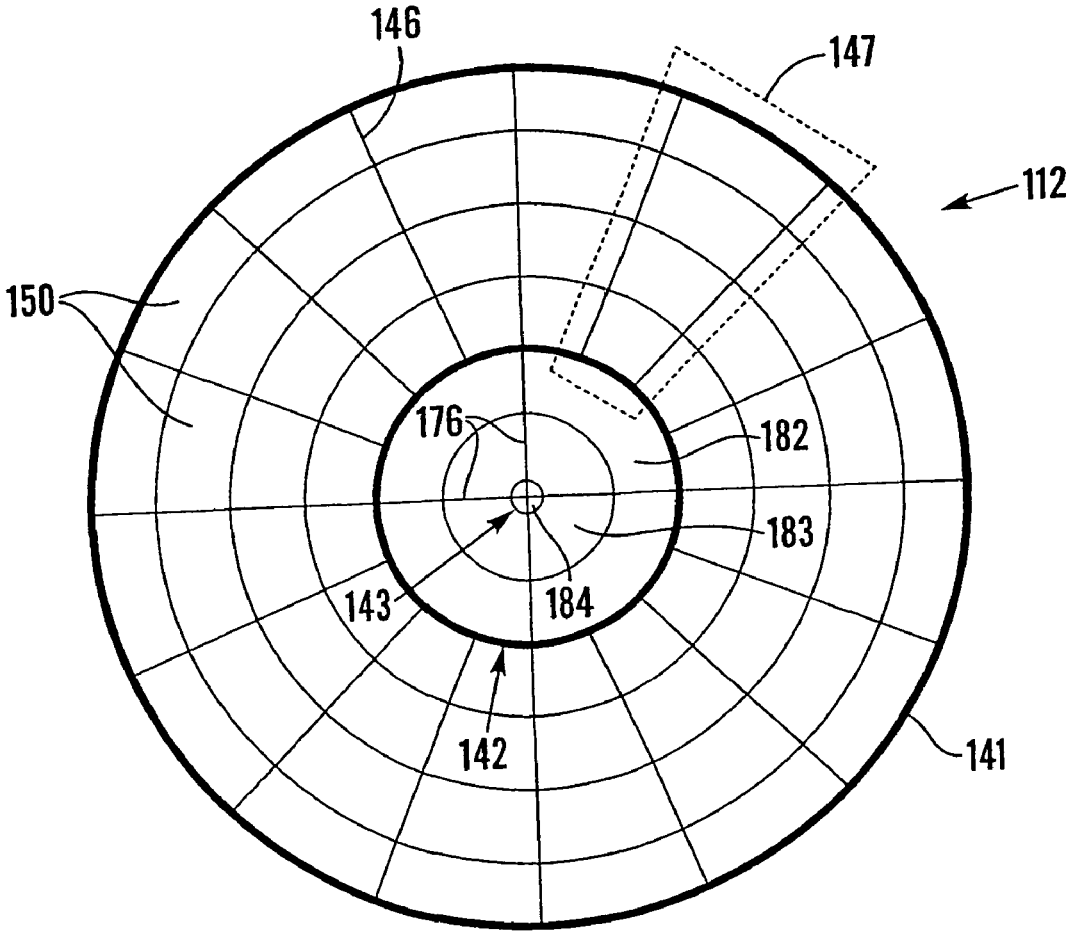
FIG. 5 is a top plan view of a ball collection arrangement in accordance with a second embodiment of the present invention.

Referring now to FIGS. 2 to 4, there is shown one of the targets 12 arranged in a substantially circular hole 40 in the ground, typically 3 meters deep. A concrete member 45 comprises a ring beam 41 which surrounds the hole and also an earth retaining wall 42. Stainless steel u-shaped bars are cast into the inner face of wall 42 to serve as retaining elements. A circular wooden platform 43 is also provided around the edge of the hole and the beam 41 and platform 43 are covered with artificial turf.

A support arrangement comprising a plurality of web members is attached to the u-shaped bars in wall 42 and is shown in FIG. 2. Diametrical web members 46, 47, 48 and 49 are first attached to wall 42 and then circular and radically extending web members 51, 52 are subsequently attached to form a cobweb pattern. The web members are preferably of high shrinkage polyester fibre. They are prestressed so as to remain substantially horizontal when supporting a load. However, if a golf ball strikes one of the web members, a substantial amount of the momentum is absorbed by the web member. To help maintain the web members horizontal they are additionally supported by poles or props 58 of plastics material.

Pockets 50 defining separate compartments are attached by means of length of touch-and-close, hooked fastening material to the web members 46–49, 51, 52. The pockets are made of open-meshed PVC coated polyester fabric material, cut and welded into four-sided shape. It will be seen that each side is substantially triangular so that the pockets 50 resemble inverted pyramids. At the bottom of every pocket 50 there is an outlet hole 55 which leads to a "sock" 59 of the same material which in turn leads to a plastics connection pipe 60, FIGS. 3 and 4.

The sides of the pockets are disposed at substantially 60° to the horizontal. The top edges of the pockets have a typical length of 1 meter to 1.5 meters.

It will be seen from FIG. 3 that the pockets are arranged in groups of ten or so, with each group defining a zone, eg zone 64. All the pipes 60 within a single zone lead to a common reading device 61 which identifies a collected golf ball by reading its code. Prom the reading devices 61, golf balls pass via channels or gutters 70 to the receptacle or hopper 22. Pipes 60 are inclined more steeply than channels 70, so that the golf balls can be identified as quickly as possible and the information fed back to the driving tee. The gradient of pipes 60 have a minimum gradient of 8°, whereas the channels 70 have a minimum gradient of 2°. Any blockages in channels 70 can be cleared later, but if a ball were to fail to reach the reading device 61, this would ruin the game.

At the centre of each target there is provided a hole 80 with a separate steel collection tube 81 and ball reader 82 for detecting and indicating a hole-in-one. A steel flagpole 83 is attached to the side of the hole. Thus it will be seen that the target is divided up into twenty two zones (including the hole 80).

By disconnecting and removing selected pockets 50, maintenance and repair personnel can gain access to walkways 85.

The above-described arrangement has numerous advantages. The holes in the fabric of pockets 50 let rain through so that there is no undesirable accumulation of rain water in the pockets. Should there be a particularly heavy snow fall, the weight of which might damage the target, the touch and close fasteners will yield and can simply be reconnected when the snow has gone.

The tension and shape of the sides of the pockets mean that a ball passes through the pocket as quickly as possible so that it can be identified, a suitable display can be made at the tee, and the game can continue. The sides are not so taut that a golf ball will bounce off them, but do not sag so that a ball cannot be retained by them.

The size and shape of the pockets in each ring of the target are identical which leads to rationalisation of manufacture.

The arrangement of the compartments formed by the pockets 50 in an array or matrix, enables the reading devices to provide information to the display as to the zone in which a ball has landed. This information can be as precise as desired and informs a golfer whether the shot was too far or too short and to the left or to the right of the hole. This feature is not available when each zone comprises a complete ring around the hole.

The targets are easily prepared and installed. An initial contractor can excavate the hole 40 and prepare the concrete member 45 in situ with the u-shaped bars cast in simultaneously. The receptacle 22 can also be installed at this stage. The pipework 60, 70 etc, the web members 46–49, 51, 52 and the pockets 50, which can be supplied in kit form, can then be installed relatively quickly.

The pockets may be of any suitable material e.g. cloth (preferably waterproof) or of plastics sheeting material. The sides may slope at any convenient angle to the horizontal. However, below 35° the golf balls tend to bounce out of the pocket which is undesirable; also, even when captured, the balls take a long time to reach the outlet of the pocket, which delays code reading. Angles above 80° require too deep a hole 40 to be cost effective.

FIGS. 5 to 11 show a target 112 in accordance with a second embodiment of the present invention. The basic support construction comprises an outer ring 141 of diameter 12.6 m, an intermediate ring 142 of diameter 4.6 m and supported on four legs (not shown) and a central ring 143 with an internal diameter of 125 mm. The hole within ring 143 corresponds to a "hole-in-one".

Figure 6:
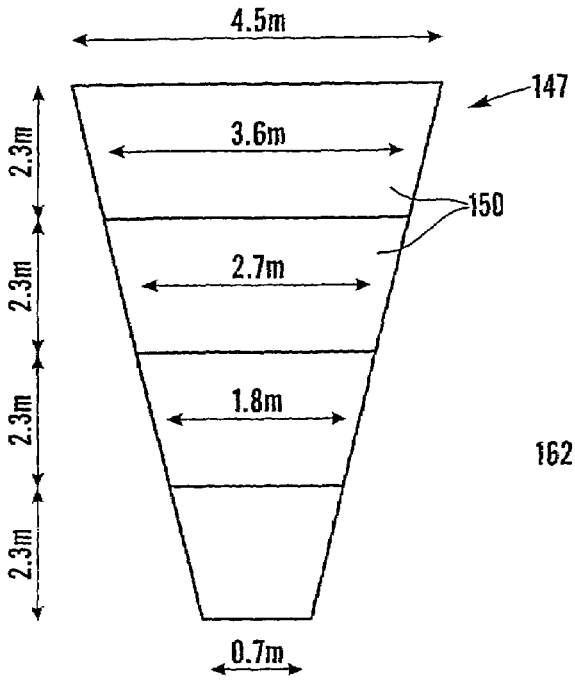
FIGS. 6 and 7 are enlarged top and side views of a segment of a modification of the embodiment of FIG. 5.
Figure 7:
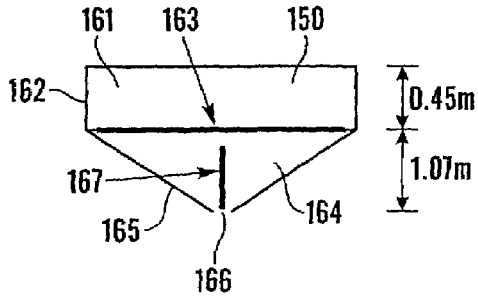

A grid of radially-extending web members in the form of steel cables 146 is suspended between rings 141 and 142. Sets of pockets 150, arranged in sixteen segments of netting 147, are suspended from the grid of cables. Each cable 146 can withstand a load of 10 KN. FIGS. 6 and 7 show the preferred dimensions of a slightly-modified segment 147 in which the pockets form polygons in plan view rather than segments of a circle (however, the preferred dimensions indicated are substantially the same).

Each pocket 150 comprises an upper region 161 with substantially vertical walls 162 and arranged to catch low driven balls. The pocket is held open by a rigid apertured former 163 which also serves as a baffle to prevent balls exiting from the top of the pocket. The former is preferably of a teardrop shape so that balls roll over it on the way in but hit it when attempting to exit. The former 163 constitutes the border between the upper region 161 and a lower region 164, the walls 165 of which slope towards the exit 166 at the bottom of the pocket. Lower region 164 is arranged to catch high lofted shots and low speed chipped shots. It also contains one or more radial baffles 167 which serve to restrict movement of a ball within region 164 and to quickly direct it to exit 166. The walls 165 of the lower region 164 are produced on the bias i.e. produced in a diamond format as opposed to the more usual squares. This has the effect of making any surplus material sag toward the exit 166 and not across the pocket. Sagging across the pocket can cause sections that stop the balls preventing them from reaching the exit 166.

The exit 166 is connected to a ball reader by means of a net connector (not shown).

Figure 8:
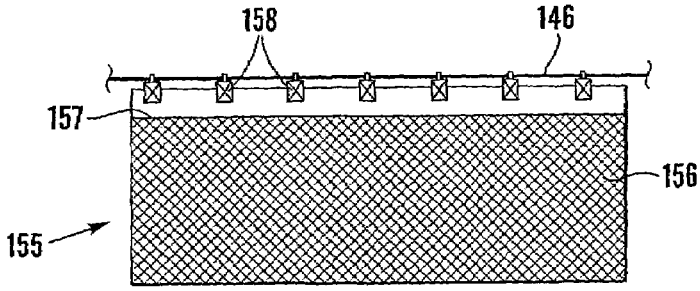
FIGS. 8 and 9 are side and top views of a pocket suspended from a web member of the arrangement of FIG. 5.
Figure 9:
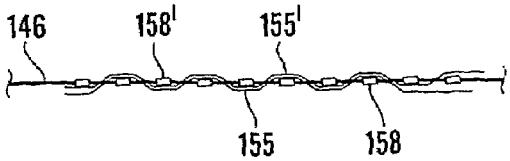

FIGS. 8 and 9 illustrate the attachment of the radially-extending wall 155 of a pocket 150 to a cable 146. The pocket comprises netting 156 sewn into a webbing strip 157 and is arranged to be suspended by a plurality of nautical hooks 158 sewn into webbing strip 157.

FIG. 9 illustrates the attachment of adjacent pocket walls 155, 155[1] to a cable 146. The hooks 158[1] supporting wall 155[1] are clipped on at intermediate points between the points at which hooks 158 for wall 155 are clipped on. In each case the hooks 158, 158[1] are clipped on from the opposite side to their respective pocket. Thus to attach a hook 158, it is first positioned at the opposite side of cable 146 and then clipped on by moving it towards cable 146. When the webbing strips 157 of the walls 155, 155[1] are pulled tight along the cable 146, there results the configuration of FIG. 9, from which it will be seen that there are no gaps between the adjacent walls of the pockets into which golf balls might fall. Thus all golf balls landing on the target are detected.

Figure 10:
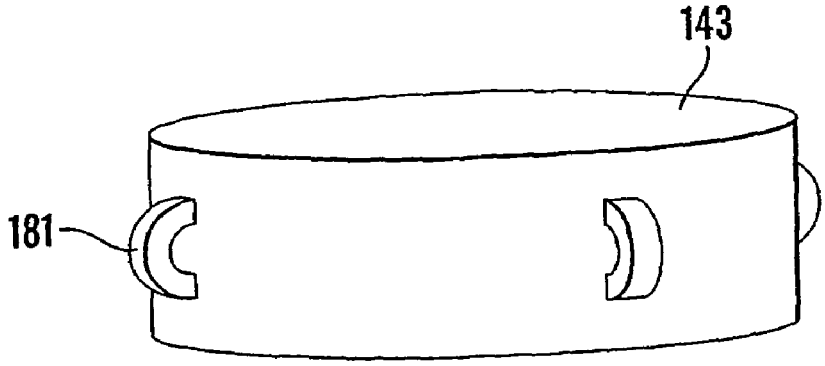
FIGS. 10 and 11 are side perspective and to plan views of a support element of the arrangement of FIG. 5.
Figure 11:
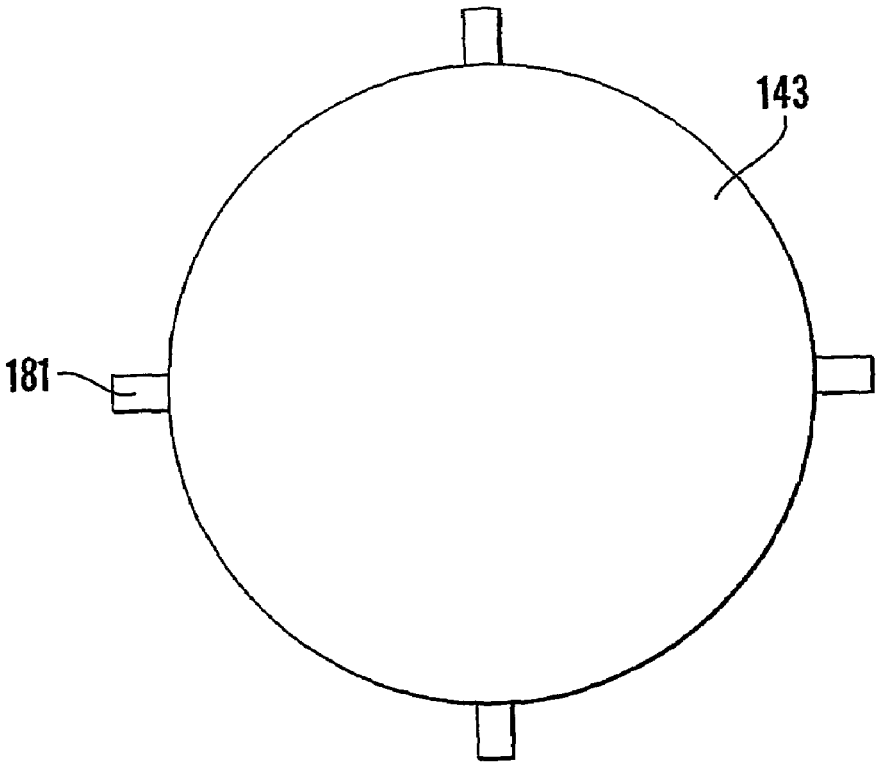

The intermediate ring 142 supports first ends of four further radially-extending steel cables 176, the second ends of which are attached to hooks 181 arranged around the periphery of the central ring 143, FIGS. 10 and 11. The hooks 181 and cables 176 can each withstand a load of 20KN.

Three pockets are concentrically arranged within intermediate ring 142. A 4.6 m diameter pocket 182 is attached to ring 142 itself. A 2.3 m diameter pocket 183 is suspended from the cables 176. A 125 mm diameter pocket 184 is contained within the central ring 143 and, as previously-mentioned, constitutes a "hole-in-one".

The arrangement of the second embodiment has the advantage of fewer parts than the first embodiment and is thus quicker and easier to install.

In a modification, pocket 184 is replaced by a pipe or other conduit.

The balls received by target 112 may be collected in a single common receptacle (similar to receptacle 22 of the first embodiment) or in a plurality of shared receptacles.

Numerous modifications can be made to the above-described embodiments. For example, the target may be arranged wholly or partly above ground level; this decreases installation expense but is not as realistic. The range may be arranged indoors, provided the roof is high enough for driving.

The pockets 50, 150, 182, 183 may be of any convenient size, shape and pattern. For smaller targets, fewer pockets are used. The pockets may be arranged in rows and columns, or in honeycomb pattern. The overall shape of the target in plan view may be elliptical, rectangular, polygonal or of irregular shape.

The features and modifications of the two embodiments may be combined and/or exchanged as desired.

The invention claimed is:

1. A device for receiving golf balls comprising a plurality of mutually adjacent pockets of flexible material, each pocket having an outlet connected to a common receptacle for collecting golf balls, wherein each pocket contains an apertured former arranged to hold the respective pocket open, each pocket further having an upper region with steeply-inclined walls and lower region having walls less steeply-inclined than the walls of the upper region, said former being provided between the upper and lower regions, and wherein the lower region contains one or more baffle members.

2. A device for receiving golf balls comprising a plurality of mutually adjacent pockets of flexible material, each pocket having an outlet connected to a common receptacle for collecting golf balls, wherein each pocket contains an apertured former arranged to hold the respective pocket open, wherein the pockets are suspended from web members extending across an opening and wherein said pockets are releasably attached to the web members, and wherein the attachment of said pockets to said web members is by means of a plurality of hook members along an edge of the pocket, the hook members being attached to the web members from the side thereof remote from the pocket.

3. The device for receiving golf balls of claim 2, wherein the web members are resilient.

4. A device for receiving golf balls comprising a plurality of mutually adjacent pockets of flexible material, each pocket having an outlet connected to a common receptacle for collecting golf balls, wherein each pocket contains an apertured former, each pocket further having an upper region with steeply-inclined walls and a lower region having walls less steeply-inclined than the walls of the upper region, said former being provided between the upper and lower regions, and said former being arranged to hold the respective pocket open and to act as a baffle to prevent balls exiting the top of the pocket.

5. A device according to claim 4, wherein the walls of the upper region are substantially vertical.

6. A device according to claim 4, wherein each pocket has a respective device at the outlet for detecting the passage of a golf ball.

7. A device according to claim 4, wherein the pockets are arranged in groups of pockets, each group having a respective device for detecting the passage of a golf ball.

8. A device according to claim 6 for receiving coded golf balls, wherein reading devices also detect the codes.

9. A device according to claim 8, wherein the outlets of the pockets are connected to the reading devices by means of first conduit means, and the reading devices are connected to said common receptacle by second conduit means, said first conduit means being steeper than said second conduit means.

10. A device according to claim 4, wherein the pockets are suspended from web members extending across an opening.

11. A device according to claim 10, wherein the web members are resilient.

12. A device according to claim 10, wherein the pockets are releasably attached to the web members.

13. A device according to claim 4, wherein the pockets are arranged in concentric rings.

* * * * *